United States Patent [19]

Götzenberger

[11] 4,344,566

[45] Aug. 17, 1982

[54] THERMOSTATIC EXPANSION VALVE

[75] Inventor: Rudibert Götzenberger, Remseck, Fed. Rep. of Germany

[73] Assignee: Ernst Flitsch GmbH & Co., Fellbach, Fed. Rep. of Germany

[21] Appl. No.: 154,491

[22] Filed: May 29, 1980

[30] Foreign Application Priority Data

Jun. 6, 1979 [DE] Fed. Rep. of Germany ..... 2922872

[51] Int. Cl.[3] ..... F25B 41/04

[52] U.S. Cl. ..... 236/92 B; 62/225

[58] Field of Search ..... 236/92 B, 92 C; 62/225, 62/217, 527; 73/368.7

[56] References Cited

U.S. PATENT DOCUMENTS

| | | | |
|---|---|---|---|
| 1,904,991 | 4/1933 | Candor | 62/217 X |
| 1,969,574 | 8/1934 | Newell | 73/368.7 X |
| 2,463,951 | 3/1949 | Carter | 236/92 B X |
| 3,014,351 | 12/1961 | Leimbach | 62/225 X |
| 3,111,816 | 11/1963 | Tilney et al. | 236/92 B X |
| 3,119,559 | 1/1964 | Heidorn | 236/92 B |

*Primary Examiner*—William E. Tapolcai, Jr.

*Attorney, Agent, or Firm*—Toren, McGeady & Stanger

[57] ABSTRACT

A thermostatic expansion valve assembly, particularly for a refrigerant cycle which includes a compressor, a condensor and an evaporator, operates in response to suction gas of the cycle and the valve assembly includes a housing defining a suction line for passage of the suction gas through the valve assembly. A valve tappet is acted upon by the suction gas for actuation of the valve assembly and a control member responsive to pressure and temperature receives the upper end of the valve tappet, with the suction gas acting on the valve tappet through the control member. The control member is formed in a cup-shaped configuration opening toward the suction line and includes a rim region projecting into the suction line and a circumferential region having a greater wall thickness than the rim region. An annular shoulder is formed on the control member and a cover plate is provided for the valve housing. The assembly includes a corrugated tube which surrounds the circumferential region of the control member and which has one end connected to the annular shoulder of the control member and another end connected to the cover plate.

2 Claims, 1 Drawing Figure

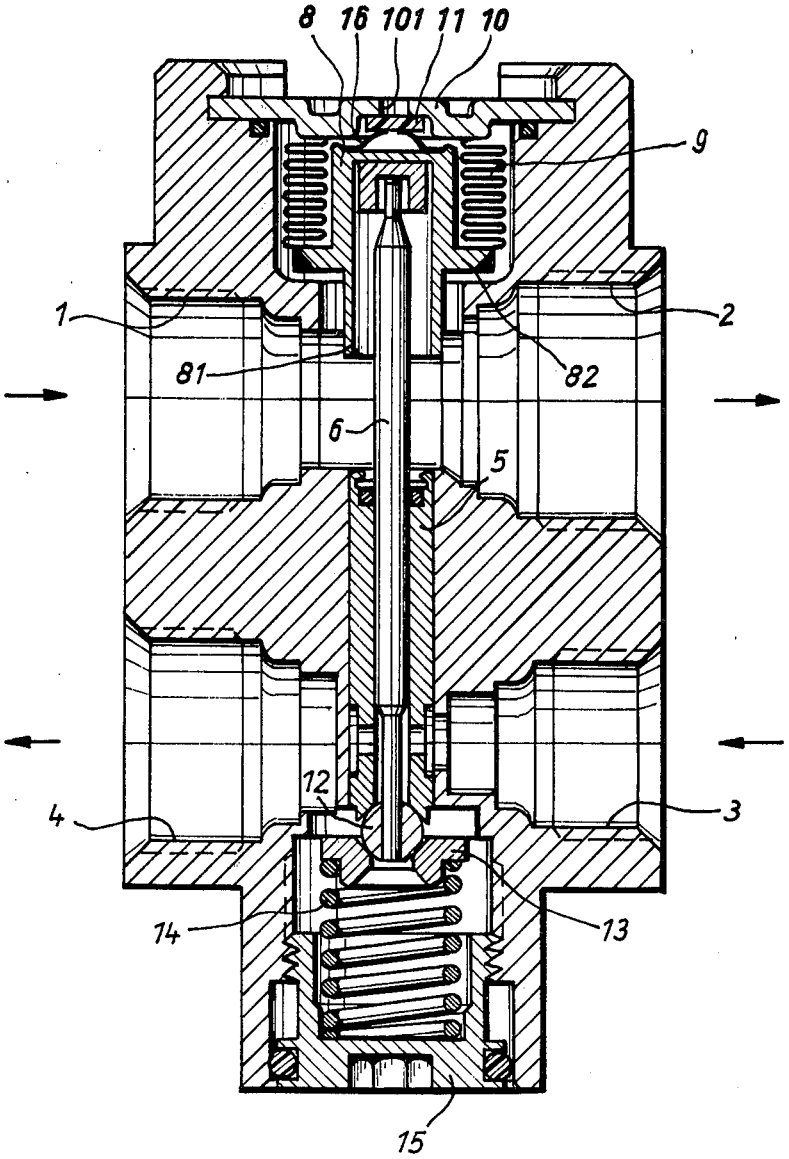
8
16
101
11
10
9
1
2
81
82
6
5
12
4
3
14
13
15

THERMOSTATIC EXPANSION VALVE

The present invention relates generally to valve assemblies particularly for use in refrigerant cycles, and more particularly to a thermostatic expansion valve for a refrigerant cycle which consists of a compressor, a condensor and an evaporator and wherein the suction gas of the cycle is conducted through a valve housing of the valve and acts upon a tappet of the valve through a control member responding to pressure and temperature.

Thermostatic valves of the type to which the present invention relates having control members which are subjected to the influence of a flowing suction gas have a rather high response speed. Therefore, the valves tend to operate in an oscillating manner. In order to reduce the speed of response of such valves, and for damping disturbing oscillations which arise therein, there has been proposed an arrangement having a diaphragm which actuates the valve tappet of the valve assembly. The valve tappet is surrounded with a sleeve of cold-resisting plastic material having low thermal conductivity. In this arrangement, the pressure of the refrigerant acts upon one side of the diaphragm and the other side of the diaphragm, which borders a chamber filled with a control medium which is temperature responsive, is subjected to the temperature of the refrigerant flowing in the suction line by means of a hollow valve tappet which is exposed to the flowing refrigerant. In this connection, reference is made to German Auslegeschrift No. 21 34 409.

The present invention is particularly directed toward a valve assembly wherein damping of the movements of the valve tappet may be effectively accomplished by means of an assembly which is generally simple in structure and operation.

SUMMARY OF THE INVENTION

Briefly, the present invention may be described as a thermostatic expansion valve assembly for a refrigerant cycle which includes a compressor, a condensor and an evaporator with the valve assembly operating in response to suction gas of the cycle. The assembly includes a valve housing defining a suction line for passage of the suction gas through the valve assembly, valve means including a valve tappet acted upon by said suction gas for actuation of said valve means, a control member responsive to pressure and temperature receiving the upper end of the valve tappet through which the suction gas acts on the valve tappet and a corrugated tube surrounds a circumferential region of the control member. The control member is formed in a cup-shaped configuration opening toward the suction line and includes a rim region projecting into the suction line with the circumferential region thereof having a greater wall thickness than the rim region. An annular shoulder is formed on the control member and the valve housing is provided with a cover plate, with the corrugated tube being arranged with one end thereof connected to the annular shoulder and with another end connected to the cover plate.

The suction line is advantageously connected to a chamber which receives the corrugated tube through a wide annular duct. A chamber defined by the corrugated tube and by the thick-walled portion of the cup-shaped control member is capable of being filled in a simple manner with a control medium which responds to temperature by virtue of the fact that the cover closing the expansion valve is provided on its end face with a bore which is maintained closed by means of a sealing disc which bears resiliently against the inside of the cover. Pressure acting on the sealing disc is provided by a spring plate which bears against the bottom of the cupshaped control member, or it may be provided by a stirrup-shaped spring arranged on the bottom of this member.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DESCRIPTION OF THE DRAWING

The single FIGURE of drawing is a cross-sectional view of a valve assembly structured in accordance with the present invention.

DETAILED DESCRIPTION OF THE PREFERRED EMBODIMENT

Referring now to the drawing, wherein a preferred embodiment of an expansion valve in accordance with the present invention is schematically illustrated, there is depicted a housing which includes an inlet 1 and an outlet 2 in its upper part in order to receive threaded pipe connections for the suction line of a refrigerant cycle to be controlled by the valve assembly.

Two additional threaded recesses 3 and 4 serve for connection of lines from the condensor and to the evaporator.

A valve tappet 6 is guided in a sleeve 5 which is inserted in the housing. The upper end of the tappet 6 bears against the bottom of a cup-shaped control member 8 through the intermediate arrangement of another cup-shaped member. The cup-shaped control member 8 is surrounded by a corrugated tube 9 which extends about its upper thick-walled portion.

The corrugated tube 9 is soldered to an annular shoulder 82 of the cup-shaped control member 8 at the lower end of the tube 9. The upper end of the corrugated tube 9 is soldered to a plate 10 which covers the end face of the valve housing and which acts as a cover plate therefor. The cover plate 10 includes a bore 101 which is closed by means of a sealing disc 11. The sealing disc 11 is, in turn, pressed against the cover plate 10 by a spring plate 16.

The cup-shaped member 8 projects with a thin-walled free rim region 81 into the section of the suction line which is located between the inlet 1 and the outlet 2. At the lower end of the valve tappet 6 there is arranged a spherical valve body 12 which bears against a valve seat 13. The valve seat 13 is held by a superheating spring 14 applying a spring tension which can be adjusted by means of a threaded nipple 15.

The varying wall thickness of the cup-shaped control member 8, in the region surrounded by the corrugated tube 9 and in the rim region 81 projecting into the suction line, results in an effective damping action of the movements of the valve tappet 6 due to the fact that transmission of heat to the temperature sensitive control medium which is enclosed in the corrugated tube 9 takes place through the walls of the cup-shaped member 8.

In order to fill the space surrounded by the corrugated tube 9 with a control medium which is temperature responsive, and to enable the preceding evacuation of this space, a filling probe provided with a transverse slot at its lower end is inserted in the bore 101 and the sealing disc 11 is pressed down by means of this probe. In this manner, the filling procedure may be effected in a significantly shorter time than is possible in known expansion valves.

Additionally, the bore 101 can be glued or soldered.

While a specific embodiment of the invention has been shown and described in detail to illustrate the application of the inventive principles, it will be understood that the invention may be embodied otherwise without departing from such principles.

What is claimed is:

1. A thermostatic expansion valve assembly for a refrigerant cycle including a compressor, a condensor and an evaporator and operating in response to suction gas of said cycle comprising: a valve housing defining a suction line for passage of said suction gas through said valve assembly; valve means including a valve tappet acted upon by said suction gas for actuation of said valve means; a control member responsive to pressure and temperature receiving the upper end of said valve tappet through which said suction gas acts on said valve tappet; said control member being formed in a cup-shaped configuration opening toward said suction line and including a rim region projecting into said suction line and a circumferential region having a greater wall thickness than said rim region; an annular shoulder formed on said control member; a cover plate for said valve housing; and a corrugated tube surrounding said circumferential region of said control member; said corrugated tube having one end connected to said annular shoulder and another end connected to said cover plate; with a spring being arranged on the outer surface of the bottom of said control member, said spring operating to press a sealing disc against a bore of said cover plate.

2. A thermostatic expansion valve assembly for a refrigerant cycle including a compressor, a condenser and an evaporator and operating in response to suction gas of said cycle comprising: a valve housing defining a suction line for passage of said suction gas through said valve assembly; valve means including a valve tappet acted upon by said suction gas for actuation of said valve means; a control member responsive to pressure and temperature receiving the upper end of said valve tappet through which said suction gas acts on said valve tappet; said control member being formed in a cup-shaped configuration opening toward said suction line and including a rim region projecting into said suction line and a circumferential region having a greater wall thickness than said rim region; an annular shoulder formed on said control member; a cover plate for said valve housing; and a corrugated tube surrounding said circumferential region of said control member; said corrugated tube having one end connected to said annular shoulder and another end connected to said cover plate; said circumferential region of said cup-shaped control member surrounded by said corrugated tube being arranged in a cylindrical recess of said valve housing, said recess being connected with said suction line through an annular duct which surrounds said rim region of said control member; with a spring being arranged on the outer surface of said control member, said spring operating to press a sealing disc against a bore of said cover plate.

* * * * *